US010172210B2

(12) United States Patent
Slaughter

(10) Patent No.: US 10,172,210 B2
(45) Date of Patent: Jan. 1, 2019

(54) SYSTEMS AND METHODS FOR GENERATING DRIVE CONDITIONS TO MAINTAIN PERCEIVED COLORS OVER CHANGES IN REFERENCE LUMINANCE

(71) Applicant: ABL IP Holding LLC, Atlanta, GA (US)

(72) Inventor: Christopher D. Slaughter, Littleton, CO (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/724,515

(22) Filed: Oct. 4, 2017

(65) Prior Publication Data

US 2018/0098402 A1 Apr. 5, 2018

Related U.S. Application Data

(60) Provisional application No. 62/403,798, filed on Oct. 4, 2016.

(51) Int. Cl.
*H05B 33/08* (2006.01)

(52) U.S. Cl.
CPC ..... *H05B 33/0869* (2013.01)

(58) Field of Classification Search
CPC .... H05B 33/02; H05B 33/08; H05B 33/0803; H05B 33/0845; H05B 33/0848;
(Continued)

(56) References Cited

U.S. PATENT DOCUMENTS 6,379,022 B1 * 4/2002 Amerson ..... H05B 33/0863 362/1
2008/0103714 A1 * 5/2008 Aldrich ..... G01J 3/46 702/81

(Continued)

OTHER PUBLICATIONS

Kerr, "The CIE XYZ and xyY Color Spaces," available online at https://www.cse.iitb.ac.in/~cs475/fall2016/handouts/2010--kerr--cie_xyz.pdf, Mar. 21, 2010, 16 pages.

(Continued)

*Primary Examiner* — Jason M Crawford
(74) *Attorney, Agent, or Firm* — Kilpatrick Townsend & Stockton LLP

(57) ABSTRACT

A method of generating drive conditions for light sources to maintain a desired color of a light emitted by the light sources, as perceived by a human observer, over a change in a reference luminance, includes determining a corrected color that produces perception of the desired color, by the human observer, in the presence of the reference luminance; and determining light source drive conditions to produce the corrected color. A light fixture includes multiple illumination panels and control electronics. Some of the illumination panels emit a reference luminance; others emit light of an accent color different from the reference luminance. The control electronics modify an intensity level of the reference luminance, and compensate drive conditions supplied to LED chips that emit the accent color, to compensate the accent color for effects of modifying the intensity level, on human perception of the accent color.

23 Claims, 9 Drawing Sheets

(58) Field of Classification Search
CPC ..... H05B 33/0854; H05B 33/0857; H05B 33/086; H05B 33/0866; H05B 33/0869
See application file for complete search history.

(56) References Cited

U.S. PATENT DOCUMENTS

2010/0097407 A1* 4/2010 Zulch ..... G01J 3/504 345/690
2010/0110672 A1* 5/2010 Durand ..... F21K 9/00 362/231
2010/0171444 A1* 7/2010 Bennette ..... H05B 33/0863 315/312
2010/0188022 A1* 7/2010 Gerlach ..... H05B 33/0866 315/312
2012/0019164 A1* 1/2012 Gambeski ..... B64D 47/02 315/294
2012/0076404 A1 3/2012 Bryant et al.
2012/0104953 A1* 5/2012 Chobot ..... H05B 33/0872 315/153
2012/0176042 A1* 7/2012 Hatley ..... H05B 33/086 315/152
2014/0286008 A1* 9/2014 Hack ..... F21K 9/90 362/249.01
2015/0305117 A1* 10/2015 Van Herpen ..... H05B 37/0227 315/153
2015/0345724 A1* 12/2015 Leadford ..... H05B 33/086 362/244
2017/0169794 A1* 6/2017 Nagano ..... G09G 5/10
2017/0238401 A1* 8/2017 Sadwick ..... A61N 5/01 315/294
2018/0106675 A1* 4/2018 Yao ..... H05B 37/02

OTHER PUBLICATIONS

Poynton, "Frequently Asked Questions about Color," available online at http://poynton.ca/PDFs/ColorFAQ.pdf, Mar. 2, 1997, 24 pages.
"RGB color space," available online at https://en.wikipedia.org/wiki/RGB_color_space, retrieved from the Internet Aug. 8, 2017, 4 pages.
Wyszecki et al., "Colorimetry," Color Science: Concepts and Methods, Quantitative Data and Formulae, 2nd Edition, Chapter 3, Aug. 2000, pp. 117-174.
Wyszecki et al., "Visual Equivalence and Visual Matching," Color Science: Concepts and Methods, Quantitative Data and Formulae, 2nd Edition, Chapter 5, Aug. 2000, pp. 278-410.

* cited by examiner

SYSTEMS AND METHODS FOR GENERATING DRIVE CONDITIONS TO MAINTAIN PERCEIVED COLORS OVER CHANGES IN REFERENCE LUMINANCE

CROSS-REFERENCE TO RELATED APPLICATIONS

This application is a non-provisional application that claims the benefit of U.S. Provisional Patent Application No. 62/403,798, filed 4 Oct. 2016 and incorporated by reference herewith in its entirety for all purposes.

BACKGROUND

Light emitting diodes (LEDs) are currently creating many new opportunities for lighting. For example, their native efficiency generates energy savings over the life of an installation, and their reliability means no need to design them for replaceability. Also, their small size, availability in various colors or chromaticities, and capacity to be dimmed instead of operating at a fixed output open up new opportunities to generate interesting patterns and lighting effects.

SUMMARY

In an embodiment, a method of generating drive conditions to maintain a perceived color over changes in reference luminance includes determining a desired color to be perceived by a human observer. The desired color is determined without influence by a reference luminance. The method also includes determining characteristics of a specific reference luminance, and determining a corrected color that produces perception of the desired color, by the human observer, in the presence of the specific reference luminance. The method also includes determining drive conditions to produce the corrected color.

In an embodiment, a light fixture includes multiple illumination panels and control electronics. One or more of the illumination panels emits a reference luminance, and one or more others of the illumination panels include light sources that emit light of an accent color that is different from the reference luminance. The control electronics are operable to modify an intensity level of the reference luminance, and compensate drive conditions that are supplied to the light sources, so that the accent color is compensated for effects of modifying the intensity level, on human perception of the accent color.

BRIEF DESCRIPTION OF THE DRAWINGS

The present disclosure is described in conjunction with the appended figures, wherein.

DETAILED DESCRIPTION

Figure 1:
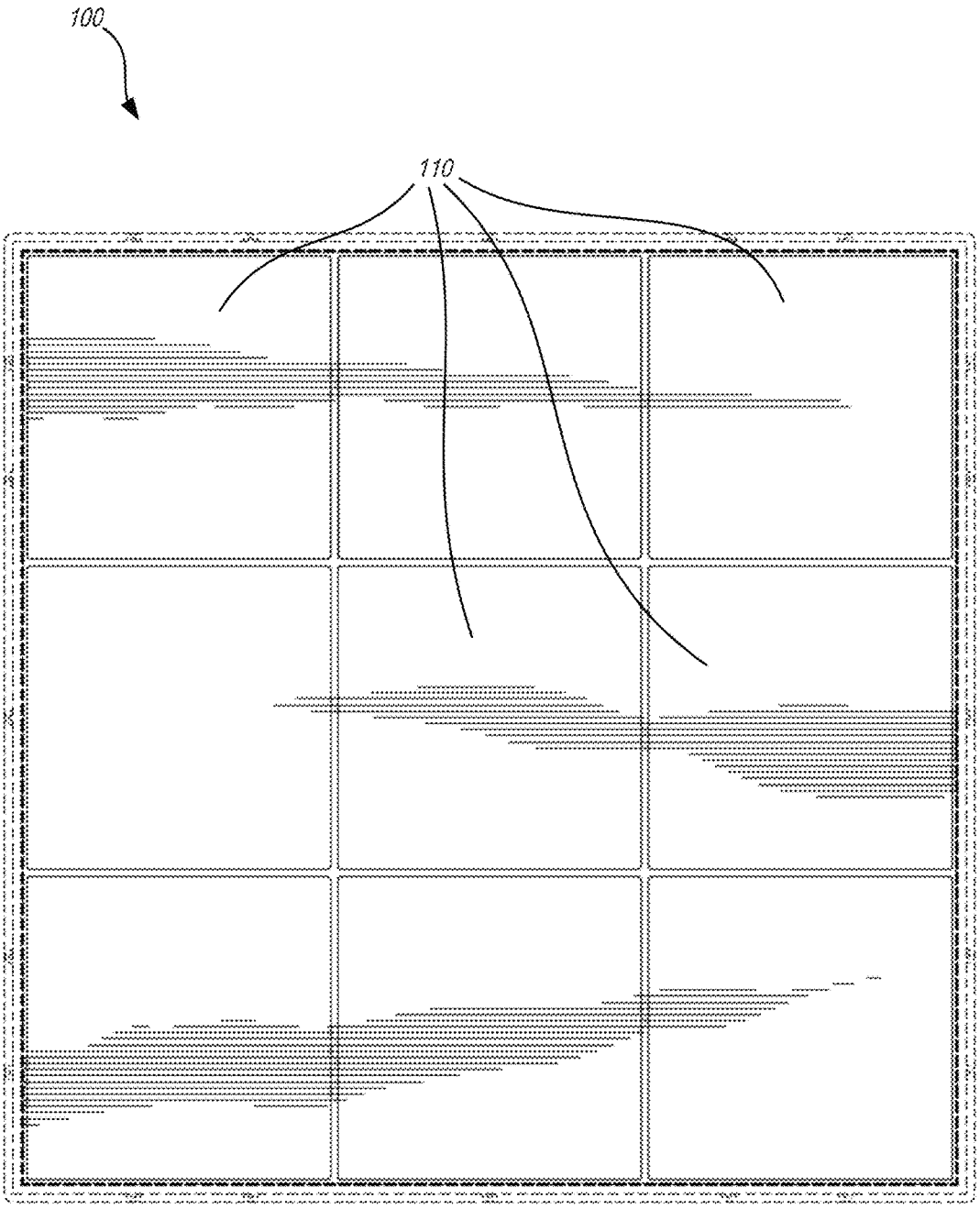
FIGS. 1-3 illustrate a luminaire having nine illumination panels, in accord with an embodiment.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. Specific instances of an item may be referred to by use of a numeral followed by a dash and a second numeral (e.g., illumination panel 110-1) while numerals not followed by a dash refer to any such item (e.g., illumination panels 110). In instances where multiple instances of an item are shown, only some of the instances may be labeled, for clarity of illustration.

Embodiments herein provide new and useful systems and methods for generating drive conditions to maintain perceived colors over changes in reference luminance. Several embodiments are contemplated and will be discussed, but embodiments beyond the present discussion, or intermediate to those discussed herein are within the scope of the present application.

Figure 2:
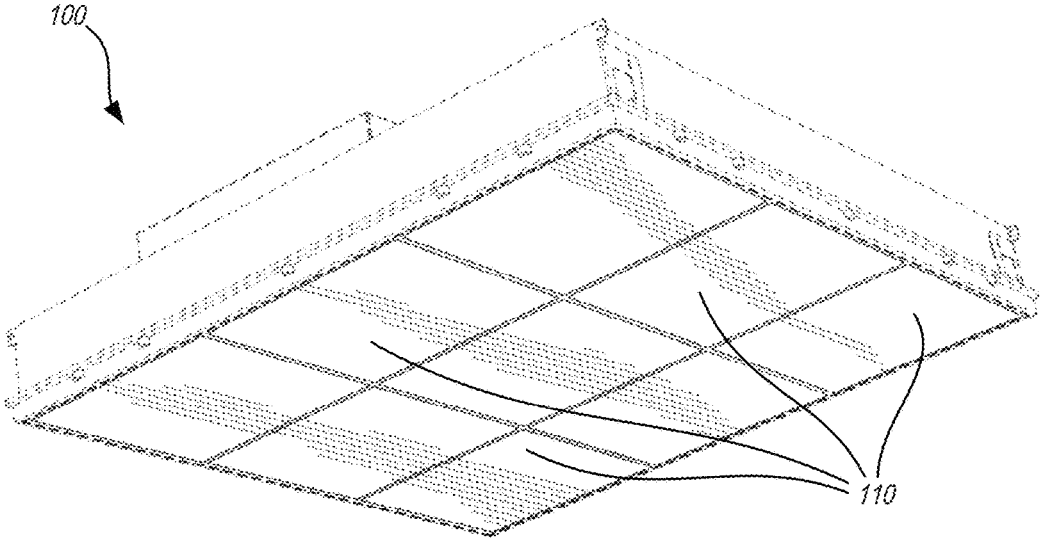
Figure 3:
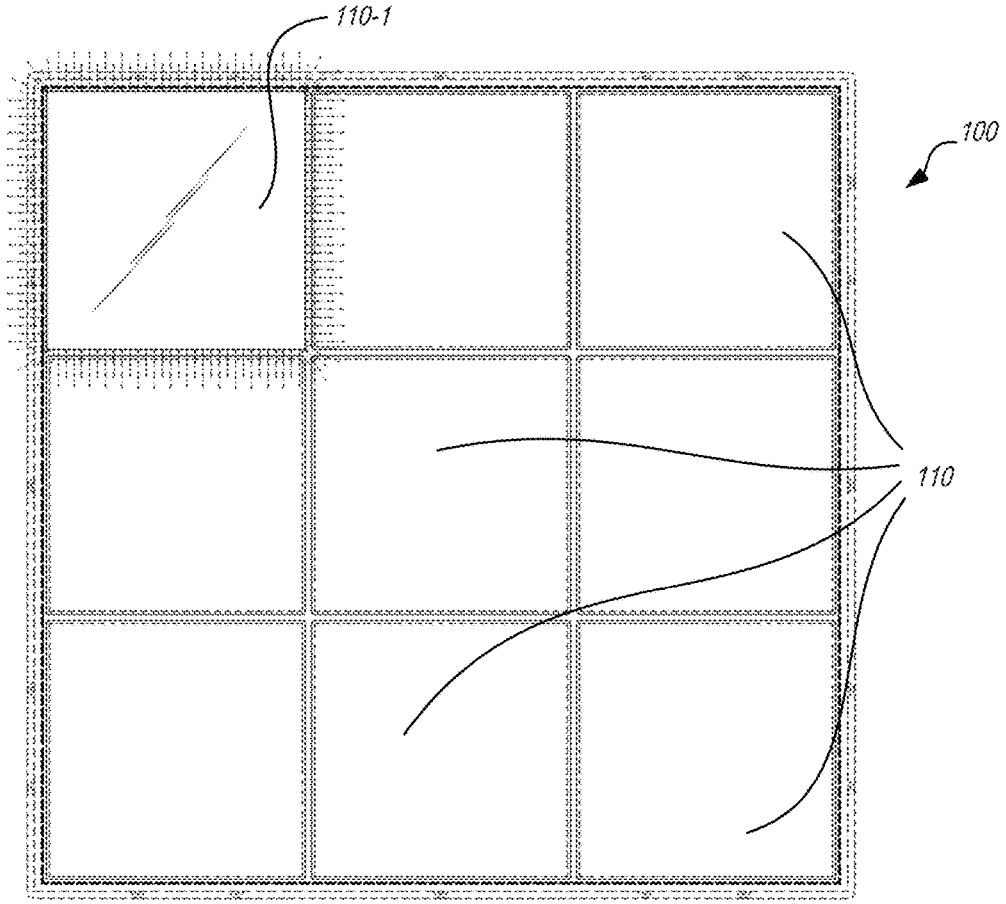
Figure 4:
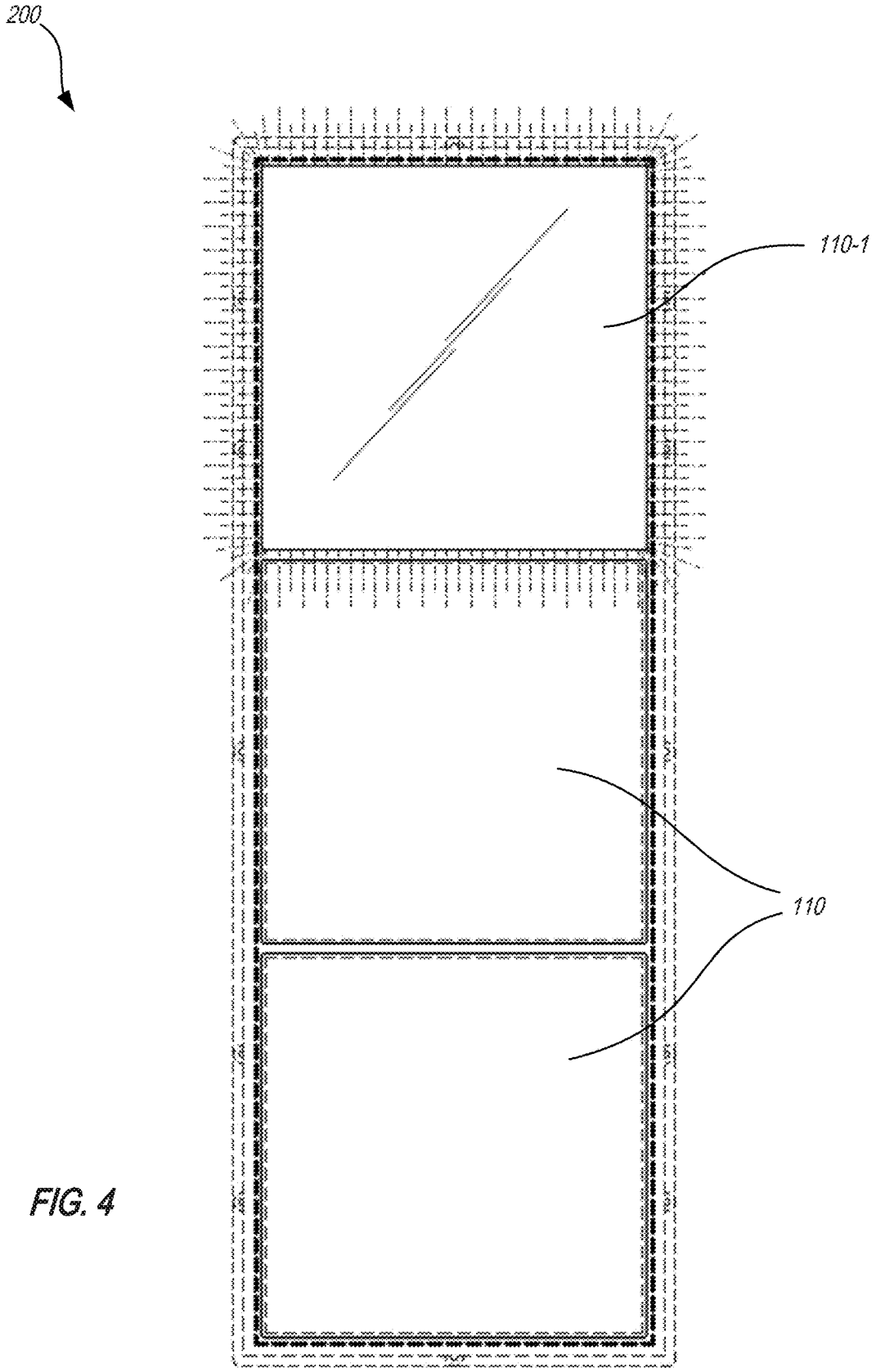
FIG. 4 illustrates, in bottom plan view, a luminaire having three illumination panels 110 arranged in a row, in accord with an embodiment.
Figure 5:
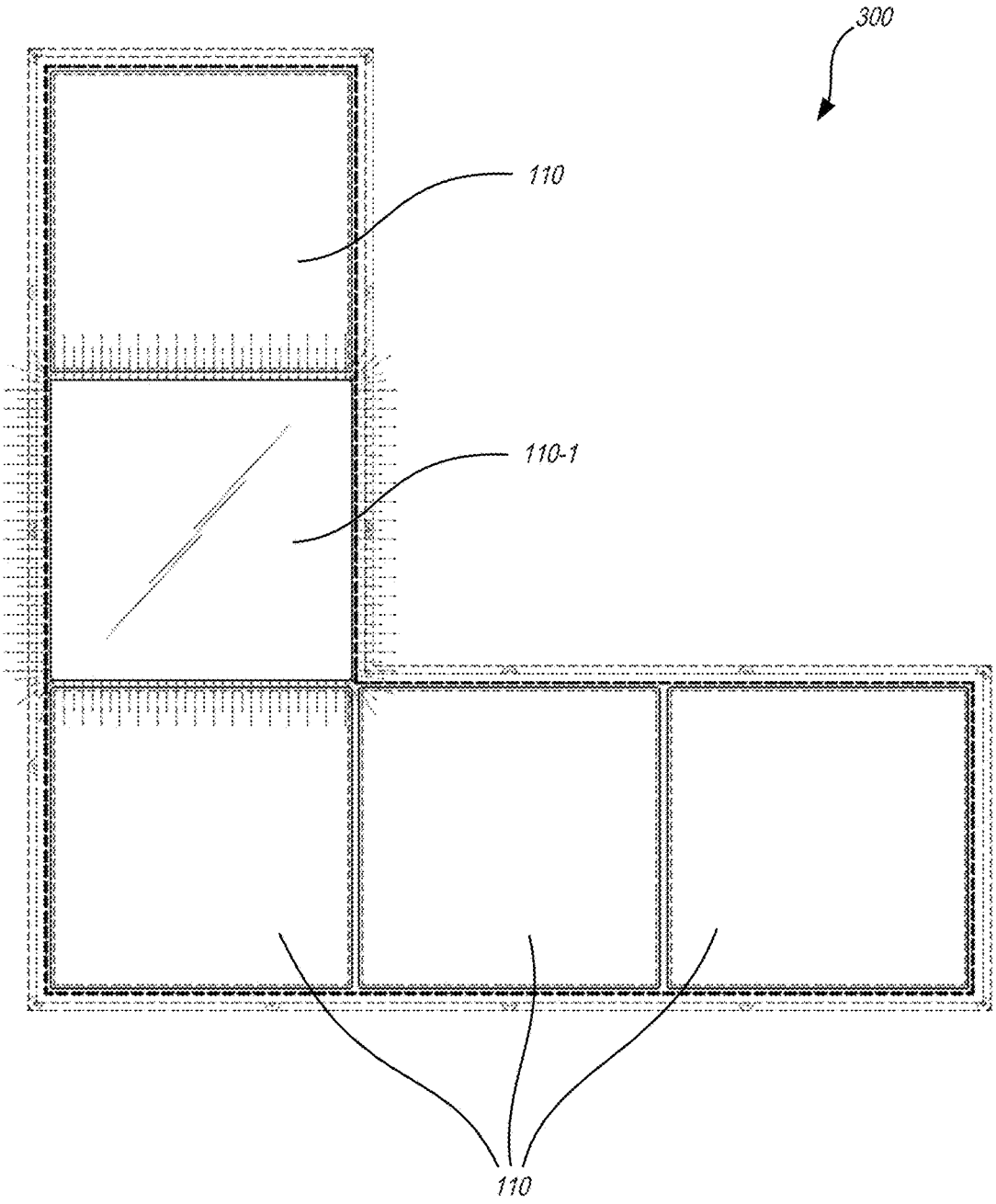
FIG. 5 illustrates, in bottom plan view, a luminaire having five illumination panels 110 arranged in a horizontal and a vertical row that intersect at a ninety degree angle to form an L-shape, in accord with an embodiment.

FIGS. 1-5 illustrate components of a design system based on luminaires with multiple illumination panels. FIGS. 1-3 illustrate a luminaire 100 having nine illumination panels 110 arranged in a 3×3 grid. FIGS. 1 and 3 are bottom plan views, while FIG. 2 is a perspective view from below. FIG. 4 illustrates, in bottom plan view, a luminaire 200 having three illumination panels 110 arranged in a row; FIG. 5 illustrates, in bottom plan view, a luminaire 300 having five illumination panels 110 arranged in a horizontal and a vertical row that intersect at a ninety degree angle to form an L-shape. Areas outside the bold broken line in each drawing are typically hidden above support structure after installation. Luminaires 100, 200 and 300 are examples of luminaires that can implement the methods described herein, but it will be clear to one skilled in the art upon reading and comprehending the present disclosure that these methods may be adapted to other types of luminaires. That is, luminaires of different shapes and layouts than luminaires 100, 200 and 300, including without limitation luminaires that have three-dimensional aspects instead of emitting light only from a planar surface, can use the methods described.

Embodiments herein generally use light emitting diodes (LEDs) as light sources due to their efficiency, their small size, and the corresponding ease with which they can be configured for a desired luminous intensity (brightness) and/or chromaticity distribution. In some embodiments, illumination panels 110 provide substantially spatially homogeneous luminous intensity across the area of each illumination panel 110, for example the luminous intensity of each illumination panel 110 may be spatially homogeneous within 15%, 10% or 5% across any given area of each panel, but this is not required. Certain embodiments herein also feature closely matched luminous intensity from panel to panel, both within a luminaire and from luminaire to luminaire, and throughout a life span of the luminaire. For example, in some embodiments, luminous intensity level is matched across all panels of an installed system to a tolerance of better than 15%, 10% or 5%, over the life span of the luminaire.

Most of illumination panels 110 of luminaires 100, 200 and 300 are typically used to provide general illumination, and thus provide light that is generally "white." That is, the light provided will have some distribution of at least two wavelengths such that the light appears white to an observer, and can be classified as having a correlated color temperature (CCT) although the light may not have a full blackbody spectrum according to some definitions of "white." However, in some embodiments, one or more illumination panels of any of luminaires 100, 200 or 300 emit light of an accent color. For example, each of FIGS. 3, 4 and 5 illustrate one illumination panel designated as 110-1 that is highlighted; illumination panels 110-1 may emit light of an accent color, while other illumination panels 110 may emit "white" light. The light provided by the other illumination panels 110 may be referred to herein as a "reference luminance" including, without limitation, situations wherein the illumination panels 110 are not illuminated (e.g., the reference luminance is zero). Both the accent color light and the reference luminance may be emitted at various brightness levels by supplying appropriate drive conditions to light sources that generate light. The accent light is primarily for aesthetic and/or commercial value in appearance of the luminaire in a direct view, not necessarily to provide colored illumination for objects illuminated by the luminaire. Commercial value can be derived from depicting a color that is strongly associated with an organization or company (e.g., possibly as a trademark, but not necessarily limited to actual trademarked colors). Present day examples of such associated colors include a certain blue for IBM, a certain red for Target stores, a certain orange for Home Depot stores and a certain yellow for Caterpillar products.

Apparatus and methods for manipulating color, intensity and/or providing dynamic variation of light provided by illumination panels 110 of the luminaires discussed herein can be readily adapted from the disclosures of U.S. Patent Applications No. 61/974,342, filed 2 Apr. 2014; Ser. No. 14/677,618 filed 2 Apr. 2015, Ser. No. 14/807,398 filed 23 Jul. 2015 and 62/325,594 filed 21 Apr. 2016 ("the Incorporated Applications"), the disclosures of which are incorporated by reference herein in their entireties for all purposes.

The present disclosure appreciates that perceived color of an object is often strongly influenced by its reference luminance, that is, the brightness (and, to some extent, by the color) of its surroundings. This is especially true for light fixtures, because in the case of an accent light, adjacent light emitters in the same fixture may be very bright. For example, consider a single illumination panel 110-1 that emits light having an orange chromaticity. When adjacent and/or surrounding illumination panels 110 are turned off, a human will readily perceive the light from illumination panel 110-1 as orange. However, as adjacent and/or surrounding illumination panels 110 increase in brightness until the reference luminance is about as bright than illumination panel 110-1, the human will perceive the light from illumination panel 110-1 as becoming a sort of dark or "dirty" orange. As the reference luminance further increases in brightness until it is much brighter than illumination panel 110-1, the human will perceive illumination panel 110-1 as becoming brown or even black. Analogous effects can be perceived in other accent colors as reference luminance of adjacent and/or surrounding light sources increases.

All of these effects are due to effects of human perception only; the light actually emitted by illumination panel 110-1 does not actually change in any of these cases. Similar effects can be observed in human perception of colors on computer monitors, but such effects can be more pronounced with lighting systems than with monitors, because the net luminance of lighting systems is typically much greater than that of monitors. Therefore, these effects are not typically compensated for in any way on computer monitors. However, light sources are currently evolving rapidly, and some light sources, particularly LEDs, enable fixtures that provide both general illumination, and accent lights that may provide aesthetic or commercial value. Thus, a need exists for correcting a displayed accent color so that it is perceived as the originally specified color, even when a human observer's visual field is influenced by adjacent or surrounding lighting.

Systems and methods for generating drive conditions for light sources used in accent lighting (e.g., illumination panel 110-1) to maintain a perceived color of the accent light, while adjacent and/or surrounding illumination panels provide a reference luminance that varies in brightness, are disclosed herein.

Figure 6:
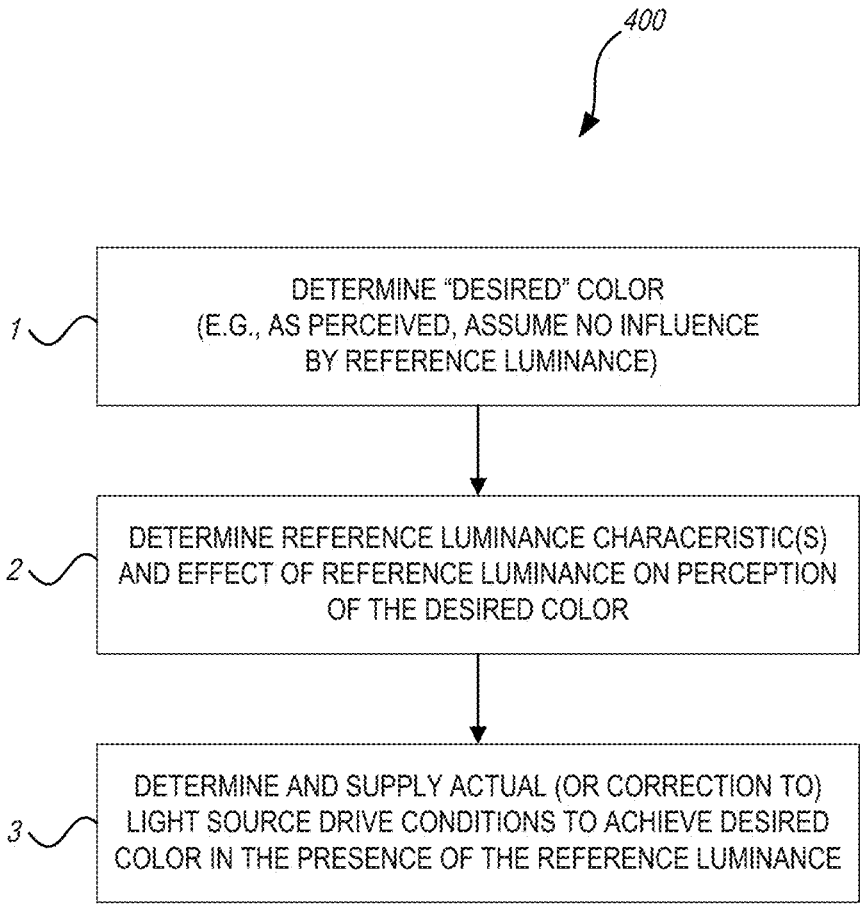
FIG. 6 shows a flowchart of a method for generating drive conditions for LEDs to maintain perceived color of an accent light, in accord with an embodiment.

FIG. 6 shows a flowchart of a method 400 for generating drive conditions for light sources to maintain perceived color of such an accent light. In step 1, a "desired" color is determined for the accent light. The desired color is determined on an "as perceived" basis, assuming no influence due to any reference luminance. That is, brightness and/or color of any surrounding light are not taken into account. Step 2 determines characteristics of a reference luminance, and a corrected color for display as the accent light that will be perceived as the desired color, given the reference luminance.

Step 3 determines and supplies actual drive conditions (or corrections to existing drive conditions) for the accent light so that the accent color is perceived as the desired color in the presence of the reference luminance. Drive conditions are understood herein to be any conditions that can be applied to light sources, such as but not limited to light emitting diodes (LEDs) that produce effects on light output. Electrical current(s) or voltage(s) that produce light of known intensity or color(s) from the light sources; amplitude, frequency, duty cycle or other parameters of pulse width modulation driving schemes; and the like, are all examples of drive conditions.

It is to be understood that method 400 may be implemented in various ways including digitally—that is, explicitly manipulating digital data to perform the calculations and transformations discussed below—or by using analog circuits that are hardwired to perform the same calculations and transformations. One skilled in the art will appreciate these and many other equivalents and modifications to the techniques disclosed herein.

Figure 7:
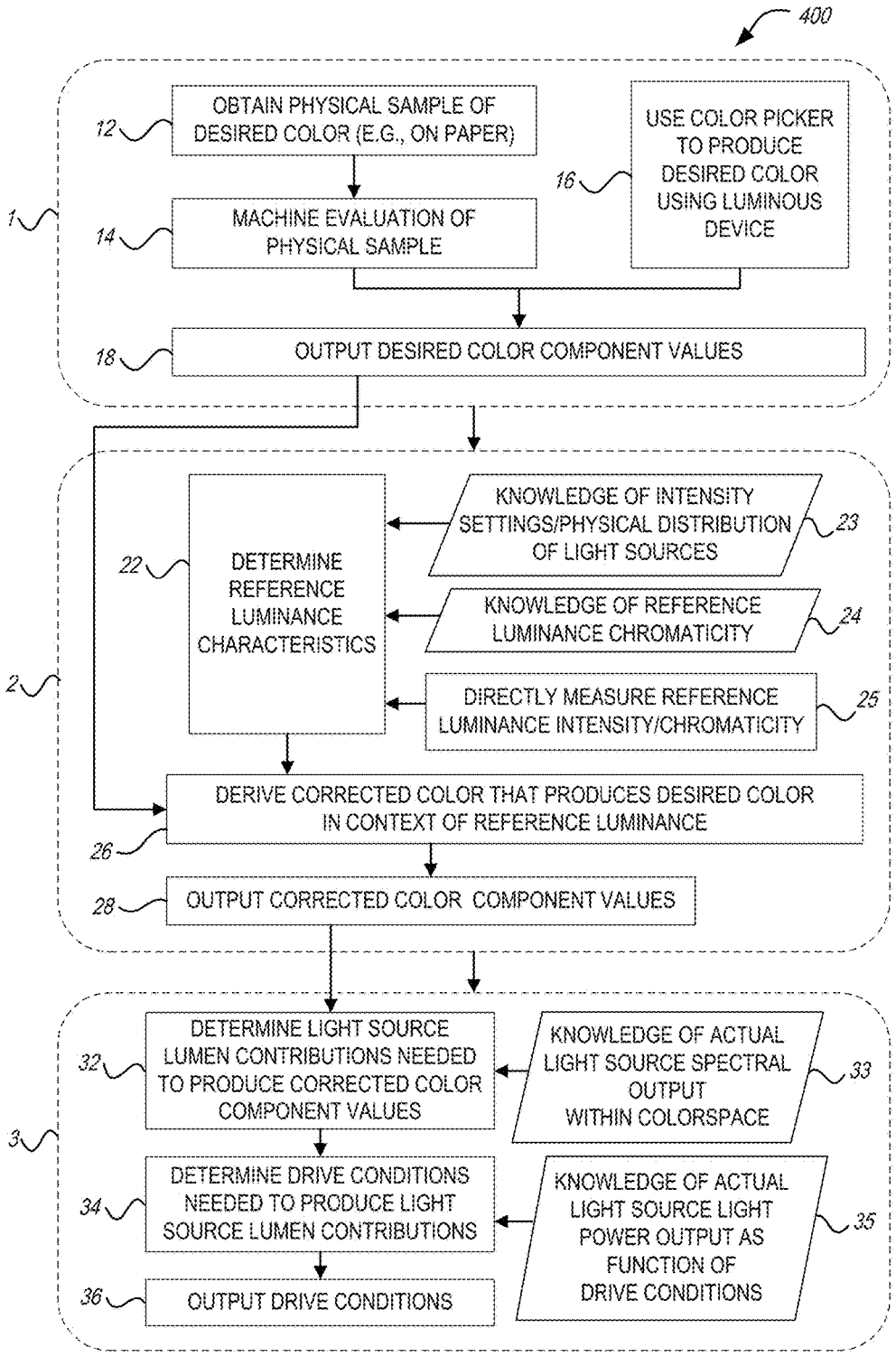
FIG. 7 shows a flowchart of the method of FIG. 6 in greater detail, in accord with certain embodiments.

FIG. 7 shows a flowchart of a method 400 in greater detail than FIG. 6, that is, some substeps that may occur within the steps of method 400 are illustrated. In FIG. 7, two different ways of implementing step 1, determining the desired color, are illustrated. One way is by obtaining a physical sample of the desired color, for example by having a user or lighting designer evaluate samples of colors supplied by color chips of paint, printed on paper or the like in sub step 12. In sub step 14, the desired color is evaluated by a machine that uses known methods to determine color components of the desired color. Color components may be expressed, for example, according to the red, blue and green (RGB) color gamut, or according to other color gamuts such as cyan, magenta and yellow/amber (CMY); red, green, blue, cyan and amber (RGBCY); or red, green, blue and white (RGBW). Another way of evaluating the desired color is by using a luminous device to generate a displayed color by providing known settings to the luminous device (the device that supplies the known settings may be thought of as a "color picker"). Then, the user or lighting designer chooses the desired color, and the known settings can be used to provide color components of the desired color, in substep 16. Step 1 then concludes at substep 18 by having the machine output the color component values of the desired color, to step 2.

Several ways of implementing step 2 of method 400 are also illustrated. A first sub step 22 determines characteristics such as brightness and/or chromaticity of a reference luminance that is (or is expected to be) adjacent to the desired color. Substep 22 may, in certain embodiments, either evaluate a measurement of the reference luminance, or may predict it based on settings of luminaire components that provide the reference luminance. Thus, substep 22 may obtain information for the prediction or evaluation step by various means. For example, knowledge of physical distribution of light emitters that are adjacent to the accent color, and intensity settings of the light emitters, provided as data 23, may be utilized. In general, the physical distribution of the light emitters is of limited importance, that is, a human observer's perception of an accent color will usually be affected about the same by presence of a bright reference luminance whether that reference luminance is adjacent to the accent color on one side, two sides, surrounding the accent color or the like. Similarly, knowledge of chromaticity of such adjacent light emitters, provided as data 24, may be utilized. Alternatively, a luminous intensity and/or chromaticity of such adjacent light emitters may be directly measured by one or more light sensors in a substep 25. A further substep 26 derives corrected color component values that will produce the desired color in the context of the reference luminance, that is, color values that will produce the appearance of the desired color to a human, while the visual system of the human is affected by the reference luminance. An example of substep 26 is described in greater detail below. A final substep 28 of step 2 provides the corrected color component values as output.

In step 3 of method 400, a substep 32 determines light source lumen contributions that produce the corrected color component values from step 2. For example, substep 32 may be specific to LED chips used in a portion of the light fixture that produces the accent color. Output spectra of specific chips can contribute to more than one of the color components of a given chromaticity. That is, a nominally "red" LED may have some "green" or "blue" output, a nominally "green" LED may have some "red" or "blue," and so on (and the color gamut may not be RGB, as noted above). Substep 32 can be readily adapted by one skilled in the art for implementation with light sources other than LEDs by using an understanding of the relative color components of light that is produced by the other light sources.

Substep 32 uses knowledge of the actual spectral output of the light sources being used, provided as data 33. A further substep 34 determines drive conditions that are expected to produce the lumen contributions determined in substep 32. Substep 34 may utilize knowledge of light power output for the light sources used in the accent light, as a function of drive conditions, provided as data 35. For example, substep 34 may provide calibration curve data as a mathematical function, or from a lookup table. Substep 34 can be readily adapted by one skilled in the art for implementation with light sources other than LEDs, by using knowledge about how drive conditions applied to the light sources to be used affect lumen contributions of light produced by the light sources. A substep 36 provides the drive conditions as output. Substep 36 may be a physical step based on the information provided by substep 34. For example, digital values for desired drive conditions that are currents may be provided to one or more digital driver circuits that provide analog output currents according to the digital values specified.

It should be noted that the generalized substeps illustrated in FIGS. 6 and 7 can be performed in a variety of ways that will be evident to one skilled in the art. The illustrated substeps can, in some embodiments, be performed in a different order from that shown, and substeps may be added or omitted. One particular implementation is now shown for illustrative purposes, and it should be understood that the following implementation is but one of the variety of ways of generating drive conditions to maintain perceived colors over changes in reference luminance.

Figure 8:
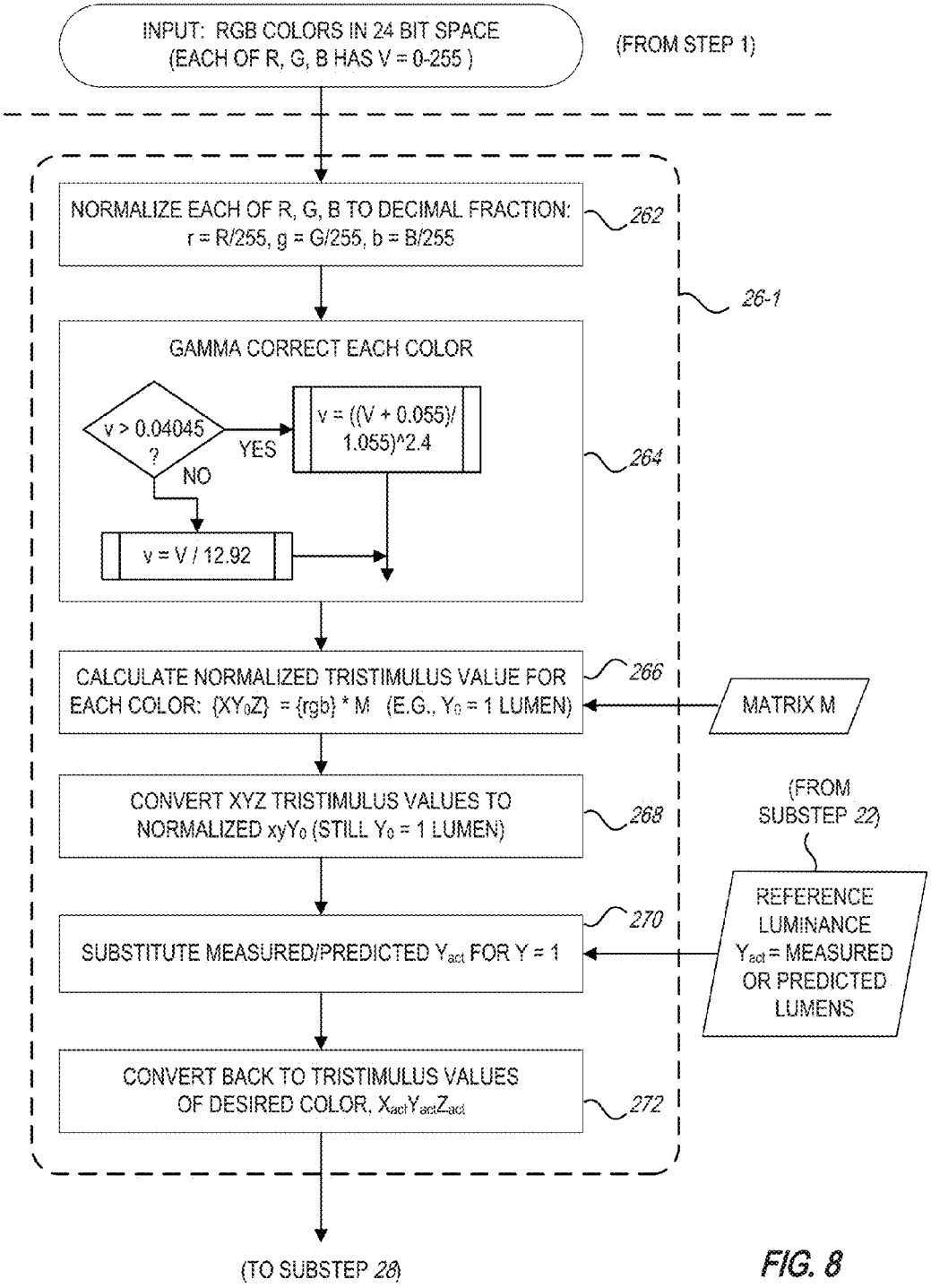
FIG. 8 illustrates implementations of one substep of the method of FIG. 6, in accord with certain embodiments.

FIG. 8 illustrates a particular implementation of sub step 26 of method 400, indicated here as 26-1. For simplicity of illustration, FIG. 8 assumes that the color gamut used is the RGB gamut, but any color gamut may be used by utilizing the gamut-specific modifications explained below.

Substep 26-1 takes as one input, a set of R, G, B values determined in step 1 of method 400, that is, the set of R, G, B values (each on a 0 to 255 scale) corresponding to a desired color for an accent light. In the calculations that follow, R, G, B values that are expressed in the usual 24 bit space (e.g., each of the three colors is expressed as an eight bit integer) are denoted by capital R, G, B or any one of them as a value denoted by a capital V. In a first substep 262 of substep 26-1, a decimal fraction value denoted by a lower case r, g, b, or any one of them as a value denoted by lower case v, is determined for each of R, G, and B by dividing by 255, such that r=R/255, g=G/255, b=B/255. In a further (and optional) substep 264 of substep 26-1, a gamma correction may be performed on each value v by using a known algorithm for scaling each v linearly if v is below 0.0405, or by an exponential function if v is above 0.0405.

To execute substep 26-1 in connection with any arbitrary color gamut, variables that characterize the desired gamut can replace R, G, B, r, g, and b, as used above and below. That is, the desired gamut can be expressed by values V1, V2, . . . Vn for any number n of variables that characterize the gamut, and if originally each of V1, V2, . . . Vn are expressed on a scale of 1 to m (e.g., m=255 for the RGB example) then v1=V1/*m*, v2=V2/*m*, . . . vn=Vn/m. For example, if the desired gamut is the red, green, blue and white (RGBW) gamut discussed above, and m=255, then r=R/255, g=G/255, b=B/255, w=W/255.

In a following substep 266 of substep 26-1, the r, g, b values determined in substep 262 are converted to normalized tristimulus values X, Y, Z. Tristimulus values X, Y and Z do not map one-to-one with r, g and b individually, that is, each value X, Y and Z has a component of each of r, g and b such that the conversion is a matter of solving simultaneous equations. In order to do this, a custom conversion matrix M is defined, including constants that, when a vector {r, g, b} is convoluted with M, provide XYZ values defining the desired color in terms of the well-known tristimulus values X, Y and Z. Thus, once M is defined, X, Y and Z for any value of r, g and b can be determined by:

$$[M]*\begin{bmatrix} r \\ g \\ b \end{bmatrix} = \begin{bmatrix} X \\ Y \\ Z \end{bmatrix} \quad \text{Eq. (1)}$$

Once again, it is noted Eq. 1 and the derivation of M below use the rgb gamut as an example, but the teachings here enable equivalent derivations for color gamuts other than rgb. Upon reading and comprehending the present disclosure, one skilled in the art will readily recognize many alternatives, modifications and equivalents.

In the derivations of M and other calculations that follow, the following known equations for converting XYZ tristimulus values to colorspace coordinates xyY, such as the well-known 1931 CIE colorspace coordinates, are used:

$$x=X/(X+Y+Z) \quad \text{Eq. (2)}$$

$$y=Y/(X+Y+Z) \quad \text{Eq. (3)}$$

$$z=Z/(X+Y+Z) \quad \text{Eq. (4)}$$

From Eq. 2, 3 and 4, it can be shown that:

$$X+Y+Z=Y/y \quad \text{Eq. (5)}$$

$$X=(Y/y)*x \quad \text{Eq. (6)}$$

$$Z=(Y/y)*(1-x-y) \quad \text{Eq. (7)}$$

$$z=1-x-y \quad \text{Eq. (8)}$$

which are identities that are useful in some calculations below.

Matrix M in Eq. 1 is generated as follows. The constants in M represent coefficients of simultaneous equations that solve for {X, Y, Z} when {r, g, b} are known. The derivation and use of M assume that each of three light sources 1, 2, 3 contribute some portion to each of total tristimulus values $X_T$, $Y_T$, and $Z_T$ (and of course, the techniques used herein are adaptable to systems that use more than three light sources to provide light of a given X, Y, Z). Thus, the coefficients in M represent simultaneous solutions of:

$$X_T=X_1+X_2+X_3 \quad \text{Eq. (9)}$$

$$Y_T=Y_1+Y_2+Y_3 \quad \text{Eq. (10)}$$

$$Z_T=+Z_2+Z_3 \quad \text{Eq. (11)}$$

where $X_1$, $X_2$, $X_3$, $Y_1$, $Y_2$, $Y_3$, $Z_1$, $Z_2$, $Z_3$ are tristimulus contributions X, Y, Z from each of the three light sources 1, 2, 3.

Eq. 9, 10 and 11 may be expanded by using Eq. 2, 3 and 4 as follows:

$$X_T=x_1*(X_1+Y_1+Z_1)+x_2*(X_2+Y_2+Z_2)+x_3*(X_3+Y_3+Z_3) \quad \text{Eq. (12)}$$

$$Y_T=y_1*(X_1+Y_1+Z_1)+y_2*(X_2+Y_2+Z_2)+y_3*(X_3+Y_3+Z_3) \quad \text{Eq. (13)}$$

$$Z_T=z_1*(X_1+Y_1+Z_1)+z_2*(X_2+Y_2+Z_2)+Z_3*(X_3+Y_3+Z_3) \quad \text{Eq. (14)}$$

Converting to matrix form, Eq. (12), (13) and (14) can be rewritten as:

$$\begin{bmatrix} x_1 & x_2 & x_3 \\ y_1 & y_2 & y_3 \\ z_1 & z_2 & z_3 \end{bmatrix} * \begin{bmatrix} (X_1+Y_1+Z_1) & 0 & 0 \\ 0 & (X_2+Y_2+Z_2) & 0 \\ 0 & 0 & (X_3+Y_3+Z_3) \end{bmatrix} * \begin{bmatrix} r \\ g \\ b \end{bmatrix} = \begin{bmatrix} X_T \\ Y_T \\ Z_T \end{bmatrix} \quad \text{Eq. (15)}$$

At this point, one chooses a "white" reference point in the colorspace of choice. In this example, the well-known D65 white point (e.g., having color of a 6500K black body) in the 1931 CIE colorspace is chosen. The corresponding X, Y, Z for this "white" are designated $X_{TW}$, $Y_{TW}$, $Z_{TW}$. The "white" point is reached when maximum possible values R, G, B are designated as the values of r, g and b. Substituting these designations into Eq. 15:

$$\begin{bmatrix} x_1 & x_2 & x_3 \\ y_1 & y_2 & y_3 \\ z_1 & z_2 & z_3 \end{bmatrix} * \begin{bmatrix} (X_1+Y_1+Z_1) & 0 & 0 \\ 0 & (X_2+Y_2+Z_2) & 0 \\ 0 & 0 & (X_3+Y_3+Z_3) \end{bmatrix} * \begin{bmatrix} R \\ G \\ B \end{bmatrix} = \begin{bmatrix} X_{TW} \\ Y_{TW} \\ Z_{TW} \end{bmatrix} \quad \text{Eq. (16)}$$

Thus, at the "white" point:

$$[M]*\begin{bmatrix} R \\ G \\ B \end{bmatrix} = \begin{bmatrix} X_{TW} \\ Y_{TW} \\ Z_{TW} \end{bmatrix} \quad \text{Eq. (17)}$$

Noting the definition of M in Eq. 1, it follows that:

$$[M] = \begin{bmatrix} x_1 & x_2 & x_3 \\ y_1 & y_2 & y_3 \\ z_1 & z_2 & z_3 \end{bmatrix} * \begin{bmatrix} (X_1+Y_1+Z_1) & 0 & 0 \\ 0 & (X_2+Y_2+Z_2) & 0 \\ 0 & 0 & (X_3+Y_3+Z_3) \end{bmatrix} \quad \text{Eq. (18)}$$

With M defined in terms of variables, it can now be reduced to constants by determining values of the variables at the chosen "white" point, and knowing the relative x, y, z of light sources 1, 2, 3. The known coordinates of the D65 point in the 1931 CIE colorspace are x=0.31271, y=0.32902, z=0.3583. By normalizing luminance Y to 1.0000, and converting the known x, y, z of the D65 chromaticity point to X and Z, using Eq. (6) and (7) above, yields $X_{TW}$=0.950429, $Y_{TW}$=1.0000, $Z_{TW}$=1.0889. By definition, R, G and B are all at a maximum of 1 at the "white" point. Then, rewriting Eq. 16 with these values, $$\begin{bmatrix} x_1 & x_2 & x_3 \\ y_1 & y_2 & y_3 \\ z_1 & z_2 & z_3 \end{bmatrix} * \quad \text{Eq. (19)}$$

-continued $$\begin{bmatrix} (X_1+Y_1+Z_1) & 0 & 0 \\ 0 & (X_2+Y_2+Z_2) & 0 \\ 0 & 0 & (X_3+Y_3+Z_3) \end{bmatrix} * \begin{bmatrix} 1 \\ 1 \\ 1 \end{bmatrix} = \begin{bmatrix} 0.9504 \\ 1.0000 \\ 1.0889 \end{bmatrix}$$

which simplifies to (swapping sides of the equation):

$$\begin{bmatrix} 0.9504 \\ 1.0000 \\ 1.0889 \end{bmatrix} = \begin{bmatrix} x_1 & x_2 & x_3 \\ y_1 & y_2 & y_3 \\ z_1 & z_2 & z_3 \end{bmatrix} * \begin{bmatrix} (X_1+Y_1+Z_1) \\ (X_2+Y_2+Z_2) \\ (X_3+Y_3+Z_3) \end{bmatrix} \quad \text{Eq. (20)}$$

In this example, light source 1 is an LED chip that has $x_1$=0.64, $y_1$=0.33; light source 2 is an LED chip that has $x_2$=0.30, $y_2$=0.60; and light source 3 is an LED chip that has $x_3$=0.15, $y_3$=0.06. Using Eq. 8, one can determine from the known values of x and y, that $z_1$=0.03, $z_2$=0.10, $z_3$=0.79. These constants can be determined for any other set of light sources 1, 2, 3 that are capable of rendering the colorspace of choice. Entering these constants into Eq. 20 yields:

$$\begin{bmatrix} 0.9504 \\ 1.0000 \\ 1.0889 \end{bmatrix} = \begin{bmatrix} 0.64 & 0.30 & 0.15 \\ 0.33 & 0.60 & 0.06 \\ 0.03 & 0.10 & 0.79 \end{bmatrix} * \begin{bmatrix} (X_1+Y_1+Z_1) \\ (X_2+Y_2+Z_2) \\ (X_3+Y_3+Z_3) \end{bmatrix} \quad \text{Eq. (21)}$$

Solving for each group of X+Y+Z, $$\begin{bmatrix} 0.64 & 0.30 & 0.15 \\ 0.33 & 0.60 & 0.06 \\ 0.03 & 0.10 & 0.79 \end{bmatrix}^{-1} * \begin{bmatrix} 0.9504 \\ 1.0000 \\ 1.0889 \end{bmatrix} = \begin{bmatrix} (X_1+Y_1+Z_1) \\ (X_2+Y_2+Z_2) \\ (X_3+Y_3+Z_3) \end{bmatrix} \quad \text{Eq. (22)}$$

Performing the matrix operation, $$\begin{bmatrix} 0.6443 \\ 1.1920 \\ 1.2030 \end{bmatrix} = \begin{bmatrix} (X_1+Y_1+Z_1) \\ (X_2+Y_2+Z_2) \\ (X_3+Y_3+Z_3) \end{bmatrix} \quad \text{Eq. (23)}$$

Rewriting Eq. 18 with these values and the known x, y, z of light sources 1, 2, 3 as determined above, $$[M] = \begin{bmatrix} 0.64 & 0.30 & 0.15 \\ 0.33 & 0.60 & 0.06 \\ 0.03 & 0.10 & 0.79 \end{bmatrix} = \begin{bmatrix} 0.6443 & 0 & 0 \\ 0 & 1.1920 & 0 \\ 0 & 0 & 1.2030 \end{bmatrix} \quad \text{Eq. (24)}$$

$$[M] = \begin{bmatrix} 0.4124 & 0.3576 & 0.1805 \\ 0.2126 & 0.7152 & 0.0722 \\ 0.0193 & 0.1192 & 0.9504 \end{bmatrix} \quad \text{Eq. (25)}$$

As noted above, the foregoing derivation of M is adaptable to use of other color gamuts, other colorspaces, different numbers of light sources capable of rendering the chosen colorspaces, and light sources that provide light of different chromaticities within the colorspaces. Once M is determined, substep 266 is performed by using Eq. 1 to apply M to calculate the desired, normalized tri stimulus values X, Y, Z for a given v1, v2, . . . vn for a color gamut of n colors (such as v1, v2, . . . vn=r, g, b for the RGB color gamut, where n=3).

In a further following substep 268, the XYZ tristimulus values are converted to colorspace units, such as the well-known 1931 CIE colorspace coordinates xyY according to Eq. (2), (3) and (4) above, and normalizing Y as $Y_0$ with a value of 1:

$$x=X/(X+Y_0+Z) \quad \text{Eq. (26)}$$

$$y=Y_0/(X+Y_0+Z) \quad \text{Eq. (27)}$$

$$Y=Y_0=1 \quad \text{Eq. (28)}$$

Because Y=1 from substep 266, these transformations allow the luminance term Y to be scaled thereafter to account for any reference luminance. Thus, in a further following sub step 270, an actual reference luminance $Y_{act}$ that is measured or predicted in substep 22 of method 400 can be substituted for $Y_0$. The resulting $xyY_{act}$ values are colorspace coordinates (e.g., 1931 CIE colorspace coordinates) for the desired color in context of the reference luminance.

A following substep 272 converts the colorspace coordinates of the desired color back to XYZ coordinates using Eq. 6, 7 above. That is, $$X_{act}=(x*Y_{act})/y \quad \text{Eq. (29)}$$

$$Y_{act}=Y_{act} \quad \text{Eq. (30)}$$

$$Z_{act}=((1-x-y)*Y_{act})/y \quad \text{Eq. (31)}$$

Having known xyY and/or $X_{act}$, $Y_{act}$, $Z_{act}$ coordinates of the desired color thus quantifies an accent light chromaticity that will be perceived as the desired color, specifically while the reference luminance is simultaneously in an observer's visual field. (That is, the xyY and/or $X_{act}$, $Y_{act}$, $Z_{act}$ would describe a chromaticity that would be perceived differently if the reference luminance were not present.)

Figure 9:
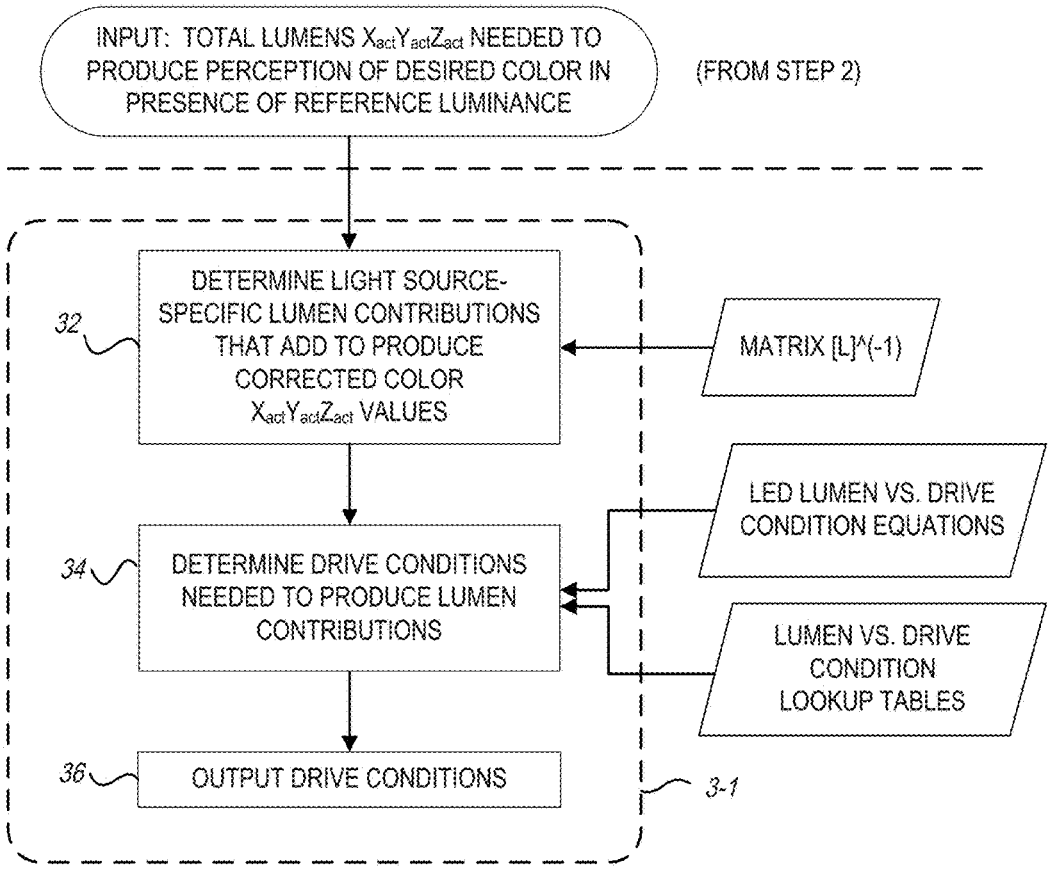
FIG. 9 illustrates implementations of one step of the method of FIG. 6, in accord with certain embodiments.

With that accent light chromaticity known, the light that can be produced by a given set of LED chips can be translated to those xyY and/or $X_{act}$, $Y_{act}$, $Z_{act}$ coordinates, and then a drive condition per chip to provide the light needed per chip can be calculated. Again, LED chips and/or other light sources generally do not provide light of single wavelengths at theoretical values of red, green and blue, but instead provide a spectrum of wavelengths that overlap the ideal subsets of red, green and blue modeled by rgb coordinates. Thus, similar to the discussion above of light sources that each contribute to several spectral bands, the drive condition calculation may involve solution of simultaneous equations, FIG. 9 illustrates mechanics of certain substeps of an example of step 3 of method 400, noted as step 3-1. Substep 32 of method 400 determines the light source lumen contributions (for example, chip-specific LED lumen contributions) needed to produce the corrected color component values for the accent light from substep 28. Substep 32 uses a matrix that is set up with constants that deconvolve lumens of light needed at theoretical values of the color components, to a combination of lumens that can actually be provided by a given set of light sources (e.g., LED chips). To do this, the light sources are initially characterized to determine the spectrum of light that each provides in each of the theoretical color components, and the determined values are set up as a system of simultaneous equations that can be solved for a needed combination of total light output across all of the color components, using inverse matrix multiplication with a matrix L, in a corollary to substep 266 discussed above. The computation of the lumen contributions can be simplified by use of an inverse matrix [L]^(−1) derived by inverting a matrix L that includes the amounts of light produced by a specific set of light sources for each color component. Like the derivation of M above, the derivation of [L]^(−1) below uses the rgb gamut as an example, but the teachings here enable equivalent derivations for color gamuts other than rgb. Upon reading and comprehending the present disclosure, one skilled in the art will readily recognize many alternatives, modifications and equivalents.

Matrix [L]^(−1) is generated as follows. The derivation and use of [L]^(−1) assume that it is desired to use each of three (or more) light sources 1, 2, 3 ( . . . n) to contribute some portion to each of total tri stimulus values $X_{act}$, $Y_{act}$, $Z_{act}$. This derivation uses, as examples, $X_{act}$, $Y_{act}$, $Z_{act}$ that will produce light at the D65 white point discussed above, at a total lumen output of 100 lumens. The D65 white point is chosen as a matter of convenience only because some of its properties are discussed above in connection with Eq. 19. Namely, for the derivation of Eq. 19, a net luminance of 1.0000, $X_{TW}$=0.950429, $Y_{TW}$=1.0000, and $Z_{TW}$=1.0889 are assumed. To provide the desired total lumen output of 100 lumens, all of the associated X, Y and Z are first scaled by a factor of 100. Writing this in matrix form, $$\begin{bmatrix} X_{act} \\ Y_{act} \\ Z_{act} \end{bmatrix} = \begin{bmatrix} 95.04 \\ 100.00 \\ 108.89 \end{bmatrix} \quad \text{Eq. (32)}$$

For clarity (so as not to use the same variables) the derivation of [L]^(−1) assumes different light sources 4, 5, 6 than those used in the derivation of M, although the same or other chips could be assumed. Similar to Eq. 9, 10 and 11, we can write equations that must be solved simultaneously to produce $X_{act}$, $Y_{act}$, $Z_{act}$ as:

$$X_{act}=X_4+X_5+X_6 \quad \text{Eq. (33)}$$

$$Y_{act}=Y_4+Y_5+Y_6 \quad \text{Eq. (34)}$$

$$Z_{act}=Z_4+Z_5+Z_6 \quad \text{Eq. (35)}$$

From Eq. 8:

$$X_4 = x_4 * \frac{Y_4}{y_4} \quad \text{Eq. (36)}$$

$$X_5 = x_5 * \frac{Y_5}{y_5} \quad \text{Eq. (37)}$$

$$X_6 = x_6 * \frac{Y_6}{y_6} \quad \text{Eq. (38)}$$

Eq. 36, 37, 38 can be rewritten as:

$$0 = -X_4 + \left[x_4 * \frac{Y_4}{y_4}\right] \quad \text{Eq. (39)}$$

$$0 = -X_5 + \left[x_5 * \frac{Y_5}{y_5}\right] \quad \text{Eq. (40)}$$

$$0 = -X_6 + \left[x_6 * \frac{Y_6}{y_6}\right] \quad \text{Eq. (41)}$$

And, from Eq. 7:

$$Z_4 = \left[\frac{1 - x_4 - y_4}{y_4}\right] * Y_4 \quad \text{Eq. (42)}$$

$$Z_5 = \left[\frac{1 - x_5 - y_5}{y_5}\right] * Y_5 \quad \text{Eq. (43)}$$

$$Z_6 = \left[\frac{1 - x_6 - y_6}{y_6}\right] * Y_6 \quad \text{Eq. (44)}$$

Eq. 42, 43, 44 can be rewritten as:

$$0 = -Z_4 + \left\{\left[\frac{1 - x_4 - y_4}{y_4}\right] * Y_4\right\} \quad \text{Eq. (45)}$$

$$0 = -Z_5 + \left\{\left[\frac{1 - x_5 - y_5}{y_5}\right] * Y_5\right\} \quad \text{Eq. (46)}$$

$$0 = -Z_6 + \left\{\left[\frac{1 - x_6 - y_6}{y_6}\right] * Y_6\right\} \quad \text{Eq. (47)}$$

Eq. 33, 34, 35, 39, 40, 41, 45, 46 and 47 thus represent nine equations in nine unknowns that can be simultaneously solved in matrix form. These equations can be rewritten as:

$$\begin{bmatrix} -1 & 0 & 0 & \frac{x_4}{y_4} & 0 & 0 & 0 & 0 & 0 \\ 0 & -1 & 0 & 0 & \frac{x_5}{y_5} & 0 & 0 & 0 & 0 \\ 0 & 0 & -1 & 0 & 0 & \frac{x_6}{y_6} & 0 & 0 & 0 \\ 0 & 0 & 0 & \frac{1-x_4-y_4}{y_4} & 0 & 0 & -1 & 0 & 0 \\ 0 & 0 & 0 & 0 & \frac{1-x_5-y_5}{y_5} & 0 & 0 & -1 & 0 \\ 0 & 0 & 0 & 0 & 0 & \frac{1-x_6-y_6}{y_6} & 0 & 0 & -1 \\ 1 & 1 & 1 & 0 & 0 & 0 & 0 & 0 & 0 \\ 0 & 0 & 0 & 1 & 1 & 1 & 0 & 0 & 0 \\ 0 & 0 & 0 & 0 & 0 & 0 & 1 & 1 & 1 \end{bmatrix} * \begin{bmatrix} X_4 \\ X_5 \\ X_6 \\ Y_4 \\ Y_5 \\ Y_6 \\ Z_4 \\ Z_5 \\ Z_6 \end{bmatrix} = \begin{bmatrix} 0 \\ 0 \\ 0 \\ 0 \\ 0 \\ 0 \\ X_{act} \\ Y_{act} \\ Z_{act} \end{bmatrix} \quad \text{Eq. (48)}$$

In this example, it is assumed that light source 4 is an LED chip that has $x_4$=0.6945, $y_4$=0.3025; light source 5 is an LED chip that has $x_5$=0.2375, $y_5$=0.7162; and light source 6 is an LED chip that has $x_6$=0.1378, $y_6$=0.0566. Using Eq. 8, one can determine the values of z from the known values of x and y, that is, $z_4$=0.033, $z_5$=0.046, $z_6$=0.806. Substituting these constants, and the known values of $X_{act}$, $Y_{act}$, $Z_{act}$ from Eq. 32, into Eq. 48 gives:

$$\begin{bmatrix} -1 & 0 & 0 & 2.295 & 0 & 0 & 0 & 0 & 0 \\ 0 & -1 & 0 & 0 & 0.331 & 0 & 0 & 0 & 0 \\ 0 & 0 & -1 & 0 & 0 & 2.434 & 0 & 0 & 0 \\ 0 & 0 & 0 & 0.0099 & 0 & 0 & -1 & 0 & 0 \\ 0 & 0 & 0 & 0 & 0.0646 & 0 & 0 & -1 & 0 \\ 0 & 0 & 0 & 0 & 0 & 14.2332 & 0 & 0 & -1 \\ 1 & 1 & 1 & 0 & 0 & 0 & 0 & 0 & 0 \\ 0 & 0 & 0 & 1 & 1 & 1 & 0 & 0 & 0 \\ 0 & 0 & 0 & 0 & 0 & 0 & 1 & 1 & 1 \end{bmatrix} * \begin{bmatrix} X_4 \\ X_5 \\ X_6 \\ Y_4 \\ Y_5 \\ Y_6 \\ Z_4 \\ Z_5 \\ Z_6 \end{bmatrix} = \begin{bmatrix} 0 \\ 0 \\ 0 \\ 0 \\ 0 \\ 0 \\ 95.04 \\ 100 \\ 108.89 \end{bmatrix} \quad \text{Eq. (49)}$$

Rearranging and inverting the matrix yields:

$$\begin{bmatrix} -1 & 0 & 0 & 2.295 & 0 & 0 & 0 & 0 & 0 \\ 0 & -1 & 0 & 0 & 0.331 & 0 & 0 & 0 & 0 \\ 0 & 0 & -1 & 0 & 0 & 2.434 & 0 & 0 & 0 \\ 0 & 0 & 0 & 0.0099 & 0 & 0 & -1 & 0 & 0 \\ 0 & 0 & 0 & 0 & 0.0646 & 0 & 0 & -1 & 0 \\ 0 & 0 & 0 & 0 & 0 & 14.2332 & 0 & 0 & -1 \\ 1 & 1 & 1 & 0 & 0 & 0 & 0 & 0 & 0 \\ 0 & 0 & 0 & 1 & 1 & 1 & 0 & 0 & 0 \\ 0 & 0 & 0 & 0 & 0 & 0 & 1 & 1 & 1 \end{bmatrix}^{-1} * \begin{bmatrix} 0 \\ 0 \\ 0 \\ 0 \\ 0 \\ 0 \\ 95.04 \\ 100 \\ 108.89 \end{bmatrix} = \begin{bmatrix} X_4 \\ X_5 \\ X_6 \\ Y_4 \\ Y_5 \\ Y_6 \\ Z_4 \\ Z_5 \\ Z_6 \end{bmatrix} \quad \text{Eq. (50)}$$

Thus, the inverted matrix of Eq. 50 is the [L]^(−1) required by substep 32 of step 3.

It is also noted that only a portion of the output of the convolution result is needed. That is, the convolution shown in Eq. 50 provides all values $X_4$, $X_5$, $X_6$, $Y_4$, $Y_5$, $Y_6$, $Z_4$, $Z_5$ and $Z_6$, but only $Y_4$, $Y_5$ and $Y_6$ are needed—that is, substep 34 only needs to know the net total lumens Y per light source, not necessarily the X and Z per light source. Performing the convolution shown in Eq. 50 and discarding the X and Z portions yields:

$$\begin{bmatrix} Y_4 \\ Y_5 \\ Y_6 \end{bmatrix} = \begin{bmatrix} 23.6 \\ 69.0 \\ 7.32 \end{bmatrix} \quad \text{Eq. (51)}$$

Thus, convoluting vector $\{X_{act}, Y_{act}, Z_{act}\}$ with [L]^(−1) produces a set of lumens that at least can be produced by the specific set of LED chip types (in some cases more than one chip of one or more of the chip types may be needed).

Once the light source-specific lumen contributions are known, substep 34 of method 400 determines the specific drive conditions that produce the lumen contributions. One example of substep 34 is to use empirically generated equations that relate light source drive conditions to lumen outputs, and solving for the drive conditions given the desired lumen outputs. Another example of substep 34 is to characterize light source lumen outputs as a function of drive conditions, store the characterization results in a lookup table, and use the lookup table data to find the drive condition that will produce the desired lumen outputs. Substep 36 of method 400 provides the drive conditions, either as digital values or, for example, by providing digital values to a digital-to-analog driver that produces an appropriate electrical current based on a digital input value.

The methods and techniques described herein can be implemented in any number of physical ways, and in many cases, not all portions thereof are performed by a single apparatus or in the order listed. For example, in one mode of carrying out the techniques herein, an end user or customer may specify an accent color to a lighting designer by choosing a color from amongst color samples, sending an example of a corporate logo printed on paper, indicating a color found in printed media, or the like (e.g., examples of substep 12 of method 400). The lighting designer may determine the actual color component values of the desired color (e.g., examples of substeps 14 or 16). The lighting designer may then determine a chip combination that can be used to produce the desired color throughout a wide range of reference luminance conditions, using factory or laboratory engineering data (e.g., examples of substeps 22, 26, 28, 32 and/or 34, using data 23, 24, 33 and/or 35, and providing output such as custom lumen vs. drive condition lookup tables for a luminaire to be manufactured). Finally, luminaires can be manufactured, that provide the accent color using the chip combination determined by the lighting designer. The luminaire can include a lighting control system that allows a user to provide user input to increase or decrease reference luminance. The luminaire also calculates the correct LED drive conditions for the accent color to remain as the desired color, for any value of the user input (e.g., further examples of at least substeps 22 and 34).

Other modes of carrying out the techniques herein can be carried out by a single apparatus that has, for example, multiples of different types of light sources such as "red," "green" and "blue" LED chips, noting that the definitions of "red," "green" and "blue" are not hard and fast, but are abstractions for amounts of output in visual spectral bands, that can be combined in various ways to achieve a desired output. Such luminaires might activate only some of the multiple light sources, depending on the accent color and/or reference luminance at which the accent color is to be provided. Single luminaires with such combinations of light sources can use information that captures light output dependence on drive conditions such as current, to determine both changes in reference luminance according to user input, and accent color correction that maintains the accent color near a specific reference luminance. Luminaires may use sensors to determine reference luminance directly, rather than calculating it based on user input. Luminaires may also take variation (either lumens and/or spectral variation) in light output caused by changes in temperature into account. Luminaires may determine appropriate drive conditions for more than one accent color, to correct each of the accent colors for reference luminance variation.

Figure 10:
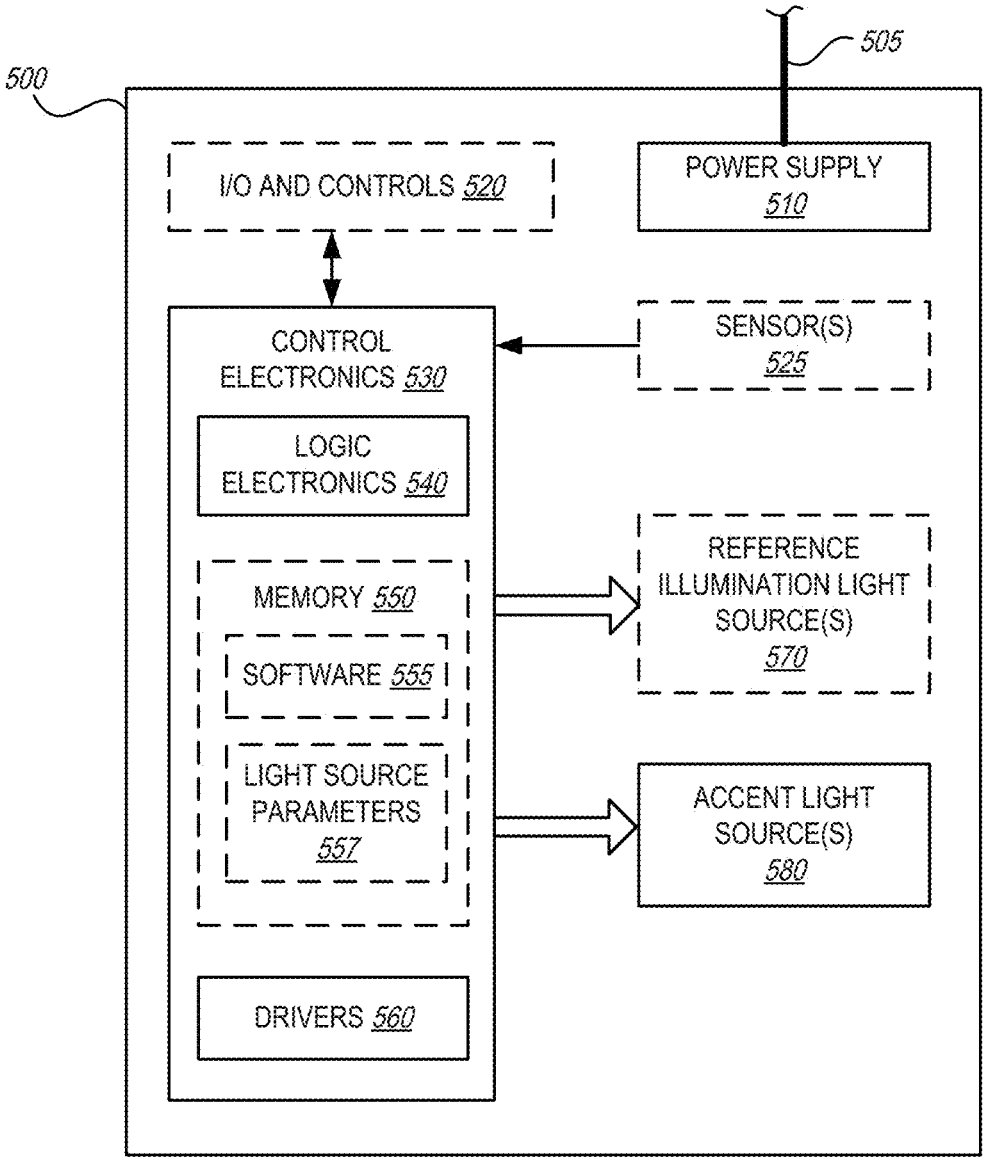
FIG. 10 is a schematic illustration of a luminaire system that can generate drive conditions to maintain perceived colors over changes in reference luminance, in accord with an embodiment.

FIG. 10 is a schematic illustration of a luminaire system 500 that can generate drive conditions to maintain perceived colors over changes in reference luminance. In certain embodiments, luminaire system 500 can, for example, implement at least steps 2 and 3 of method 400. Luminaire system 500 includes at least one power supply 510 that takes external electrical power 505, conditions the power, if needed (e.g., performs AC to DC conversion, modifies voltage of the power, or the like) and supplies power to the other components shown in FIG. 10 and described below. Connections are provided among power supply 510 and the other components, but are omitted in FIG. 10 for clarity of illustration. Luminaire system 500 includes at least accent light source(s) 580, and may include reference illumination light source(s) 570. Luminaire system 500 may include input/output (I/O) and controls 520 to receive user input such as desired illumination level to be supplied by optional reference illumination light source(s) 570, mode selection for luminaire system 500 (e.g., whether luminaire system 500 should operate with accent light source(s) 580 displaying an accent color at all, or in a general illumination mode where all light sources, including accent light source(s) 580, provide white light) or other options. Luminaire system 500 may also include one or more sensors 525 to measure reference illumination directly. However, I/O and controls 520, and sensors 525 are optional. For example, luminaire system 500 may, in embodiments, simply take variations in supplied external power 505 as input (e.g., external power 505 having been modified by an external dimmer switch), and execute one or more of the functions described below based on the input. Connections among I/O and controls 520, sensor(s) 525 and control electronics 530 are shown as single arrows with arrows denoting directions of information flow (e.g., control electronics 530 may feed information back to I/O and controls 520, such as indicator light states or information to be displayed on a user control panel). Connections from control electronics 530 to reference illumination light source(s) 570 and accent light source(s) 580 are shown as broad arrows to denote that they are generally multiple lines carrying signals and/or power to multiple illumination devices. (For example, accent light source(s) 580 are generally multicolor LEDs or multiple strands of single-color LEDs, each color requiring a separate power line so that the colors can be controlled independently; reference illumination light source(s) 570 may also include at least multiple devices or multicolor devices that can be adjusted in unison to provide custom color temperature illumination and the like).

Luminaire system 500 includes control electronics 530 that determine and supply drive conditions for accent light sources 580, so that light emitted by accent light sources 580 is compensated for changes in reference luminance. That is, control electronics 530 execute at least steps 2 and 3 of method 400 described above. In order to obtain the reference luminance characteristics for substep 22 of method 400, the reference luminance may be provided by luminaire system 500 itself (e.g., by reference illumination light source(s) 570), or it may be sensed by optional sensors 525, or information of the reference luminance may be provided to control electronics 530 through I/O and controls 520. Control electronics 530 include logic electronics 540 that determine changes in drive conditions so that accent light sources 580 can compensate for changes in the reference luminance, so that a viewer of accent light sources 580 perceives a desired color irrespective of the reference luminance. Logic electronics 540 then control drivers 560, which provide the drive conditions to accent light sources 580.

In certain embodiments, logic electronics 540 are analog circuits that react to the information of the reference luminance by generating one or more analog outputs that are passed to drivers 560, which in turn react to the outputs by providing the appropriate drive conditions to accent light sources 580. In other embodiments, logic electronics 540 include a digital processor that takes analog and/or digital information from I/O and controls 520, and/or sensors 525, performs the calculations described above in connection with method 400, and passes digital control signals to drivers 560. In these embodiments, logic electronics 540 may execute instructions of software 555 stored in optional memory 550, and may reference light source parameters 557 (e.g., lookup tables and/or parametric data for equations that describe spectral output of light sources, reactions of light sources to drive conditions, and the like, that is, any of data 23, 24, 33, 35). In still other embodiments that are intermediate to the all-analog and all-digital embodiments, logic electronics 540 are partially analog and partially digital. For example, some elements of I/O and controls 520, and/or one or more sensors 525, may provide analog output that is received and digitized by one or more analog inputs of logic electronics 540, after which the calculations (e.g., substeps 26, 28, 32, 34 of method 400) are performed digitally. Similarly, logic electronics 540 may include analog output circuits that provide input to drivers 560. These and other equivalents and modifications will be evident to one skilled in the art.

It is to be understood that depiction of luminaire system 500 within a box in FIG. 10 is intended only to illustrate what components may be included in a given system 500, but does not exclude embodiments from having only some of the illustrated components, having multiples of the components or from housing the components in a single enclosure. Upon reading and comprehending the present disclosure, one skilled in the art will readily recognize many alternatives, modifications and equivalents. Among these are embodiments that include some of the components of system 500 at one location but operate reference illumination source(s) 570 and/or accent light source(s) 580 in other, single or multiple locations. In these embodiments, drivers I/O and controls 520 and/or sensors 525 may be co-located with the other components of system 500, or may be located separately from them. When located separately, connections between I/O and controls 520, sensors 525 and/or the other components of system 500 may be connected through physical wiring or wireless connections (e.g., through radio wave, optical or microwave communications). Similarly, any or all of power supply 510, I/O and controls 520, sensors 525 and control electronics 530 and/or subcomponents thereof may be separate components within system 500, as shown, or may be combined and integrated with one another. External devices such as computers, smart phones and the like can connect with system 500 (again, through wiring or wireless connections) to provide user input.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps or substeps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A method of generating drive conditions for one or more first light sources of a luminaire to maintain a desired color of a light emitted by the one or more first light sources, as perceived by a human observer, over a change in a reference luminance emitted by one or more second light sources of the luminaire, the method comprising:

determining a corrected color that produces perception of the desired color, by a human observer, when a specific reference luminance is emitted by the one or more second light sources; and determining drive conditions for the one or more first light sources to produce the corrected color.

2. The method of claim 1, further comprising determining the desired color without influence by a reference luminance.

3. The method of claim 1, further comprising:

expressing the desired color as values V1, V2, . . . Vn of a desired gamut, wherein the desired gamut is expressed in terms of n colorspace coordinates.

4. The method of claim 3, wherein the desired gamut is an RGB gamut, and expressing the desired color comprises expressing the desired color as R, G, and B values.

5. The method of claim 1, further comprising determining the change in the reference luminance.

6. The method of claim 5, wherein determining the change in the reference luminance comprises measuring the reference luminance.

7. The method of claim 5, wherein determining the change in the reference luminance is based at least in part on a known intensity setting of the one or more second light sources that supply the reference luminance.

8. A method of generating drive conditions for one or more light sources to maintain a desired color of a light emitted by the one or more light sources, as perceived by a human observer, over a change in a reference luminance, the method comprising:

expressing the desired color as values V1, V2, . . . Vn of a desired gamut, wherein the desired gamut is expressed in terms of n colorspace coordinates;

converting the desired color to a vector {v1, v2, . . . vn} wherein v1, v2, . . . vn are normalized decimal fractions of V1, V2, . . . Vn;

determining a corrected color that produces perception of the desired color, by a human observer, when a specific reference luminance is present; and determining drive conditions for the one or more light sources to produce the corrected color.

9. The method of claim 8, wherein the desired gamut is an RGB gamut, and converting the desired color to a vector comprises expressing the desired color as a vector {r, g, b} wherein r, g and b are normalized decimal fractions of R, G, and B.

10. The method of claim 8, further comprising performing a gamma correction on each of v1, v2, . . . vn.

11. The method of claim 8, further comprising expressing the desired color as a normalized $XY_0Z$ tristimulus value by convoluting the vector {v1, v2, . . . vn} with a matrix.

12. The method of claim 11, further comprising converting the normalized $XY_0Z$ tristimulus value to a desired color $xyY_0$ colorspace value.

13. The method of claim 12, wherein determining the corrected color comprises substituting a $Y_{act}$ value corresponding to an intensity of the reference luminance, for $Y_0$ in the desired color $xyY_0$ colorspace value, to determine a corrected color $xyY_{act}$ colorspace value.

14. The method of claim 13, further comprising converting the corrected color $xyY_{act}$ colorspace value to a corrected color $X_{act}$, $Y_{act}$, $Z_{act}$ tristimulus value.

15. The method of claim 14, wherein:

the one or more light sources comprise a plurality of LED chips; and determining the drive conditions is based at least in part on a known spectral output of the plurality of LED chips, to determine lumen contributions from the LED chips that will provide the corrected color $X_{act}$, $Y_{act}$, $Z_{act}$ tristimulus value.

16. The method of claim 15, wherein determining the drive conditions based at least in part on the known spectral output of the plurality of LED chips comprises convoluting a vector {$X_{act}$, $Y_{act}$, $Z_{act}$} with an inverse matrix.

17. The method of claim 15, wherein determining the drive conditions further comprises determining drive conditions for the LED chips that will produce the lumen contributions based at least in part on a known light power output of the plurality of LED chips in response to drive conditions.

18. A method of generating drive conditions for one or more light sources to maintain a desired color of a light emitted by the one or more light sources, as perceived by a human observer, over a change in a reference luminance, the method comprising:

determining a corrected color that produces perception of the desired color, by a human observer, when a specific reference luminance is present;

determining drive conditions for the one or more light sources to produce the corrected color; and determining the change in the reference luminance, wherein determining the change in the reference luminance comprises:

receiving, at a luminaire that includes the one or more light sources and an additional light source that supplies the reference luminance, a user input to change the reference luminance;

providing additional drive conditions, by the luminaire, to the additional light source to change the reference luminance;

and wherein determining the change in the reference luminance is based at least in part on a known response of the additional light source to the additional drive conditions.

19. A light fixture, comprising multiple illumination panels, wherein:

one or more of the illumination panels emits a reference luminance, and one or more others of the illumination panels include LED chips that emit light of an accent color that is different from a color of the reference luminance; and control electronics that provide drive conditions to the illumination panels, wherein:

the control electronics are operable to modify an intensity level of the reference luminance by modifying the drive conditions supplied thereto; and the control electronics compensate drive conditions that are supplied to the LED chips, so that the accent color is compensated for effects of modifying the intensity level, on human perception of the accent color.

20. A light fixture, comprising:

one or more accent light sources that emit light of a color; and control electronics that supply drive conditions to the one or more accent light sources, wherein the control electronics:

determine changes in a reference luminance adjacent to the one or more accent light sources, and compensate the drive conditions that are supplied to the one or more accent light sources, so that the color is compensated, to maintain a human perception of the color as unchanged when the reference luminance changes;

the light fixture further comprising one or more reference light sources that emit the reference luminance, and wherein the control electronics determine the changes in the reference luminance based on changes in drive conditions that are supplied to the one or more reference light sources.

21. The light fixture of claim 20, the control electronics comprising stored light source parameters, and wherein the control electronics utilize the stored light source parameters to determine the changes in the reference luminance that will result from the changes in the drive conditions that are supplied to the one or more reference light sources.

22. The light fixture of claim 20, wherein:

the control electronics express the color as a normalized $XY_0Z$ tristimulus value;

the control electronics convert the normalized $XY_0Z$ tristimulus value to a desired color $xyY_0$ colorspace value; and the control electronics substitute a $Y_{act}$ value corresponding to an intensity of the reference luminance, for $Y_0$ in the desired color $xyY_0$ colorspace value, to determine a corrected color $xyY_{act}$ colorspace value.

23. The light fixture of claim 22, wherein:

the control electronics convert the corrected color $xyY_{act}$ colorspace value to a corrected color $X_{act}$, $Y_{act}$, $Z_{act}$ tristimulus value; and the control electronics determine lumen contributions from a plurality of LED chips in the one or more accent light sources that will provide the corrected color $X_{act}$, $Y_{act}$, $Z_{act}$ tristimulus value based at least in part on a known spectral output of the plurality of LED chips.

* * * * *